US009041488B2

(12) United States Patent
Arnold et al.

(10) Patent No.: US 9,041,488 B2
(45) Date of Patent: May 26, 2015

(54) ADJUSTABLE WAVEGUIDE BUSBAR

(71) Applicant: Tesat-Spacecom GmbH & Co. KG, Backnang (DE)

(72) Inventors: Christian Arnold, Backnang (DE); Jean Parlebas, Burgstetten (DE); Charles Thibaut, Stuttgart (DE)

(73) Assignee: Tesat-Spacecom GmbH & Co. KG, Backnang (DE)

( * ) Notice: Subject to any disclaimer, the term of this patent is extended or adjusted under 35 U.S.C. 154(b) by 25 days.

(21) Appl. No.: 14/064,363

(22) Filed: Oct. 28, 2013

(65) Prior Publication Data

US 2014/0118085 A1 May 1, 2014

(30) Foreign Application Priority Data

Oct. 29, 2012 (DE) ..... 10 2012 021 157

(51) Int. Cl.
*H01P 5/12* (2006.01)
*H01P 1/207* (2006.01)

(52) U.S. Cl.
CPC . *H01P 5/12* (2013.01); *H01P 1/207* (2013.01)

(58) Field of Classification Search
CPC ..... H01P 1/207; H01P 1/209; H01P 5/04; H01P 5/12; H01P 5/182
USPC ..... 333/113, 135, 137
See application file for complete search history.

(56) References Cited

U.S. PATENT DOCUMENTS

| | | | | |
|---|---|---|---|---|
| 3,056,096 | A | 9/1962 | Vane | |
| 4,327,330 | A * | 4/1982 | Ranghelli | 330/56 |
| 4,567,401 | A * | 1/1986 | Barnett et al. | 315/5 |
| 4,614,920 | A * | 9/1986 | Tong | 333/135 |
| 6,191,664 | B1 * | 2/2001 | Fiedziuszko et al. | 333/126 |
| 6,392,508 | B1 * | 5/2002 | Damphousse et al. | 333/209 |
| 2013/0335165 | A1 * | 12/2013 | Arnold et al. | 333/135 |

FOREIGN PATENT DOCUMENTS

DE 10 2009 003 884 A1 7/2010

* cited by examiner

*Primary Examiner* — Patrick O'Neill
(74) *Attorney, Agent, or Firm* — Crowell & Moring LLP

(57) ABSTRACT

A waveguide busbar for conducting microwaves includes a group input for coupling in a group microwave signal, a plurality of filter inputs for coupling in a plurality of microwave signals, a dual waveguide that comprises a first single waveguide and a second single waveguide. The plurality of filter inputs are disposed along the dual waveguide, as well as at least one adjustable coupling member that provides a connection between the first single waveguide and the second single waveguide and that is configured such that it adjusts a phase length of the connection.

14 Claims, 4 Drawing Sheets

ADJUSTABLE WAVEGUIDE BUSBAR

CROSS-REFERENCE TO RELATED APPLICATIONS

This application claims priority to German Patent Application No. 10 2012 021 157.0, filed Oct. 29, 2012, the entire disclosure of which is herein expressly incorporated by reference.

FIELD OF THE INVENTION

Exemplary embodiments of the present invention relate to a waveguide busbar for conducting microwaves, a multiplexer and a method for adjusting a multiplexer.

BACKGROUND OF THE INVENTION

Communications satellites utilize multiplexers that split a single microwave signal, with regard to the different frequencies, in bands and/or that combine such bands again into a single microwave signal.

A typical output multiplexer comprises, for example, channel filters connected to a waveguide busbar, such that a minimum of disturbing interaction occurs between the channel filters. To this end, it is possible to optimally determine the phase lengths between the individual channel filters on the busbar and the phase lengths between the busbar and the channel filters during development to avoid that them from influencing each other.

If the channel filters of the output multiplexer are individually adjustable in terms of frequency and/or bandwidth, new requirements can result for the busbar. A possible multiplexing concept for adjustable channel filters provides for the use of a circulator chain. The channels are first divided with the aid of a coupler in such a manner that, in terms of frequency, only non-neighboring channels remain on each arm of the coupler. Using, for example, circulators, the energy having a first frequency that is reflected on a first channel is routed then further to additional channels. At the end of the circulator chain, a reflection-free terminator prevents energy from be reflected back in an uncontrolled manner. This approach is often not suited for high-performance multiplexers, because, due to the division in non-neighboring frequencies, half of the energy is absorbed in the reflection-free terminator. In addition, the circulators can generate increased losses and passive intermodulation, which may not be acceptable for operating high-performance output multiplexers

SUMMARY OF THE INVENTION

Exemplary embodiments of the present invention provide a flexible multiplexer for processing microwave signals with high output, and which has low dissipation.

One aspect of the invention relates to a waveguide busbar for conducting microwaves. The waveguide busbar can be composed of a plurality of waveguides that are configured for conducting microwaves. For example, a waveguide can be a cavity or a pipe that is made of metal or another suitable material, respectively.

According to one embodiment of the invention, the waveguide busbar comprises a group input for coupling in a group microwave signal and a plurality of filter inputs for coupling in a plurality of microwave signals. The inputs can each be provided by an opening in the waveguide busbar. Coupling in a microwave signal can be understood as routing a microwave signal in or out.

The waveguide busbar further comprises a dual waveguide that comprises a first single waveguide and a second single waveguide, wherein the plurality of filter inputs is disposed along the dual waveguide, and at least one adjustable coupling member that provides a connection between the first single waveguide and the second single waveguide and that is configured to adjust a phase length of the connection. An individual waveguide therein can be a pipe-like waveguide. The cross-section of a single waveguide can be configured in any particular way, such as rectangular or circular.

A dual waveguide can be configured having two parallel pipe-like waveguides connected to each other at least at one location in the middle (different from the ends thereof) such that they are connected to each other (by the internal volumes thereof). The dual waveguide can be understood as two separate individual busbars that are coupled to each other.

The adjustable and/or variable coupling member can be used to actively adjust the amount and the phase position of the coupled energy between the two individual waveguides. This makes it possible to adjust an effective total phase between microwave filters over wide ranges, for example for channel filters that are coupled to the filter inputs.

The total phase length of the dual waveguide between two filter inputs can be a superimposition from the phase lengths of two single waveguides that are adjustable based on the amount and the phase of the adjustable coupling member.

According to one embodiment of the invention, the adjustable coupling member is mounted between two adjacent filter inputs, in terms of a direction of extension of the dual waveguide. In other words, the internal volume of the dual waveguide (comprising the internal volumes of the single waveguides) can extend in a first direction, and the filter outputs can branch off from the dual waveguide along that direction. The connection of the internal volumes of the single waveguides can be disposed in this case between two filter outputs. Correspondingly, the phase relationship between two adjacent filter inputs can be adjusted by means of the associated coupling member.

According to one embodiment of the invention, at least two adjustable coupling members (with regard to the direction of extension of the dual waveguide) are mounted between two adjacent filter inputs, whereby a wider range of possible phase relationships can be adjusted.

According to one embodiment of the invention, the first single waveguide and the second single waveguide extend in parallel. The first single waveguide and the second single waveguide can be connected via a plurality of adjustable coupling members that connect the first and the second single waveguides in a ladder-type fashion.

According to one embodiment of the invention, the first single waveguide and/or the second single waveguide provide the group input at one end. However, it is also possible for the ends of the single waveguides to be coupled together into a common group input.

According to one embodiment of the invention, the first single waveguide has a cross-section that differs from the cross-section of the second single waveguide. The two single waveguides can have, for example, a rectangular cross-section of different a-dimensions (meaning different heights, when the single waveguides extend in a width direction), thereby having different waveguide lengths so that the electrical length in both waveguides is different.

According to one embodiment of the invention, the busbar comprises at least one further (adjustable) coupling member, which connects the first single waveguide to the second single waveguide. It should be understood that the single waveguides are also connected to non-adjustable coupling members and/or connection openings, which can have a fixed phase length.

The first single waveguide can have a phase length between the adjustable coupling member and the further coupling member that differs from a phase length of the second single waveguide between the adjustable coupling member and the further coupling member. This can be achieved, for example, by differently sized internal volumes, cross-sections and and/or lengths of the sections of the single waveguides between the connections to the coupling members.

For example, one of the single waveguides can be configured with (section-wise) longer conduction lengths to achieve an electrical length that differs from the other single waveguide.

According to one embodiment of the invention, at least one filter input is disposed on the first single waveguide and at least one filter input is disposed on the second single wave guide. The filter inputs (and/or the correspondingly filters) can only be mounted on one of the two single waveguides (for example, only on the first single waveguide or only on the second single waveguide). It is possible for filter inputs (and/or the corresponding filters) to be mounted on both single waveguides.

In general, the coupling member can be a mechanical device by which it is possible, for example, to adjust the cross-section of the connection and/or the internal volume of the connection between the two single waveguides.

According to one embodiment of the invention, the coupling member comprises an adjustable aperture and/or a variable coupling aperture. Using an adjustable aperture it is possible to enlarge or reduce the opening between the two single waveguides.

According to one embodiment of the invention, the coupling member comprises an adjustable resonator. The adjustable (coupling) resonator can provide an adjustable internal volume that is connected to the two single waveguides. A coupling resonator of this kind can be operated, for example, in TE011 mode or TE111 mode. By a suitable selection of the resonance frequency of the resonator, it is possible to adjust the phase position of the coupling between the two single waveguides.

It must be understood that the waveguide busbar can comprise an adjustable aperture as a first coupling member and an adjustable resonator as a second coupling member. In total, the waveguide busbar can comprise structurally identical or different coupling members.

According to one embodiment of the invention, the waveguide busbar further comprises an actuator for mechanically changing the coupling member. The actuator can be a motor, for example. The actuator is able to adjust the opening area of the aperture or the volume of the adjustable resonator, for example by means of a slide and/or a piston.

According to one embodiment of the invention, the waveguide busbar further comprises a controller for controlling the coupling member. The controller is able to detect which phase relationship is to be adjusted by the coupling member, and it then triggers the actuator correspondingly.

A further aspect of the invention relates to a multiplexer with a waveguide busbar of the kind as described above and below. For example, the multiplexer can be an input multiplexer or an output multiplexer of a communications satellite.

The multiplexer can comprise a plurality of microwave filters that are connected to the filter inputs of the waveguide busbar. The microwave filters can also be adjustable. For example, the microwave filters can comprise actuators that can be used for adjusting the bandwidth and mean frequency thereof. These actuators can be triggered by the controller.

A further aspect of the invention relates to a method for adjusting a multiplexer of this kind. For example, the method can be implemented by the controller of the busbar, for example by triggering actuators of one or several coupling members and the microwave filter.

According to one embodiment of the invention, the method comprises the steps of: changing the bandwidth and/or mean frequency of a first microwave filter that is coupled to the dual waveguide; and changing the phase relationship between the first microwave filter and a second microwave filter, that is coupled with the dual waveguide, by adjusting the coupling member that connects the first single waveguide and the second single waveguide. Typically, not only the first microwave filter but the bandwidth and/or mean frequency of the second microwave filter are adjusted as well.

Embodiments of the invention will be described in further detail below in reference to the enclosed figures.

BRIEF DESCRIPTION OF THE FIGURES

As a matter of principle, identical or similar parts are identified by the same reference symbols.

DETAILED DESCRIPTION OF THE EMBODIMENTS

Figure 1:
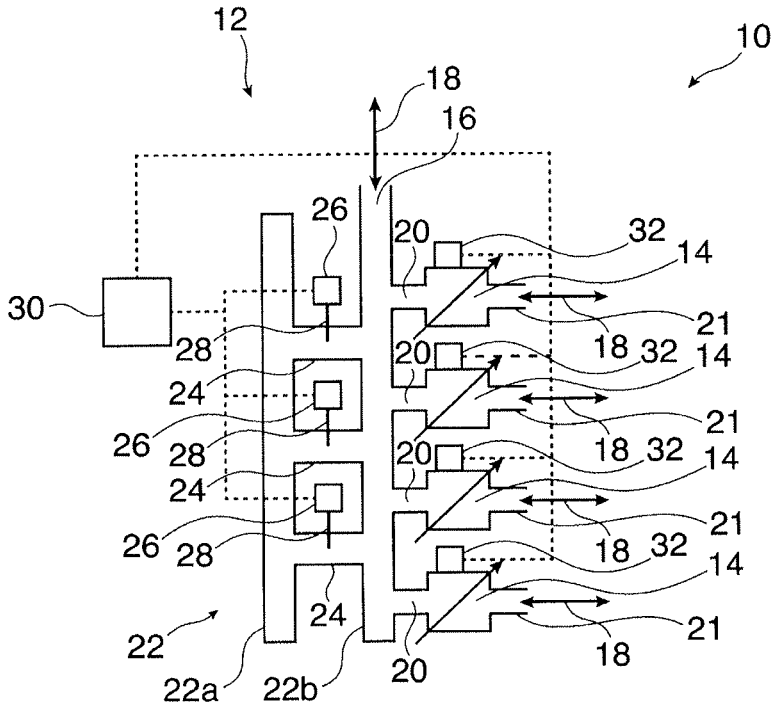
FIG. 1 is a representation of a schematic view of a multiplexer according to an embodiment of the invention.

FIG. 1 shows a multiplexer 10 that comprises a waveguide busbar 12 and a plurality of adjustable channel filters 14. In one group input 16 of the busbar 12, it is possible to couple a microwave signal 18 into or out of the multiplexer. The busbar further comprises a plurality of filter outputs 20 by which the channel filters 14 can be connected to the busbar. The channel filters 14 in turn each include an output 21 by which a microwave signal 24 can be coupled into or out of the multiplexer 10.

For example, a microwave signal 18 can be routed into a multiplexer 10 via the group input 16, is then routed by the busbar 12 to the filter outputs 20 and distributed, and then divided in bands by the channel filters 14.

The busbar 12 comprises a dual waveguide 22 that comprises two single waveguides, 22*a*, 22*b* that each have a pipe-like internal volume. The two pipe-like internal volumes extend essentially parallel. One opening on the end of a single waveguide 16 provides the busbar 16. The two single waveguides 22*a*, 22*b* are connected to each other via the coupling members 24 in the manner of a ladder.

With the exception of the busbar 16, the single waveguides 22*a*, 22*b* can be closed at the ends thereof. Moreover, the single waveguides 22*a*, 22*b* can include sack-like end areas at the ends thereof.

Each coupling member 24 can be adjusted such that a phase length of a section of the dual waveguide 22, which is connected to the coupling member 24, can be modified by the coupling member. To this end, for example, an actuator 26 of the coupling member is able to open an aperture 28 by which the size of the opening and/or the cross-section of the opening of the coupling member 24 can be changed.

Generally, the coupling member 24 can be configured such that a volume and/or cross-section of the internal volume of the coupling member 24 can be adjusted and/or changed by the actuator 26.

The waveguide busbar 12 and/or the multiplexer 10 further comprise(s) a controller 30 configured such that it triggers the actuators 26 in order to adjust the coupling members 24. The coupling members 24 can be adjusted independently of each other, and/or they can be adjusted to different positions (meaning phase lengths).

The channel filters 14 are adjustable by the controller 30. In particular, the mean frequency thereof, meaning the frequency when the lowest attenuation occurs, and the bandwidth can be adjusted. The channel filters 14 include an actuator 32 that is triggered by the controller 30 to adjust the mean frequency and the bandwidth.

FIG. 1 shows that the filter inputs are only provided by a single waveguide 22*b* and that respectively one single adjustable coupling member 24 is disposed between two neighboring filter inputs 20.

Figure 2:
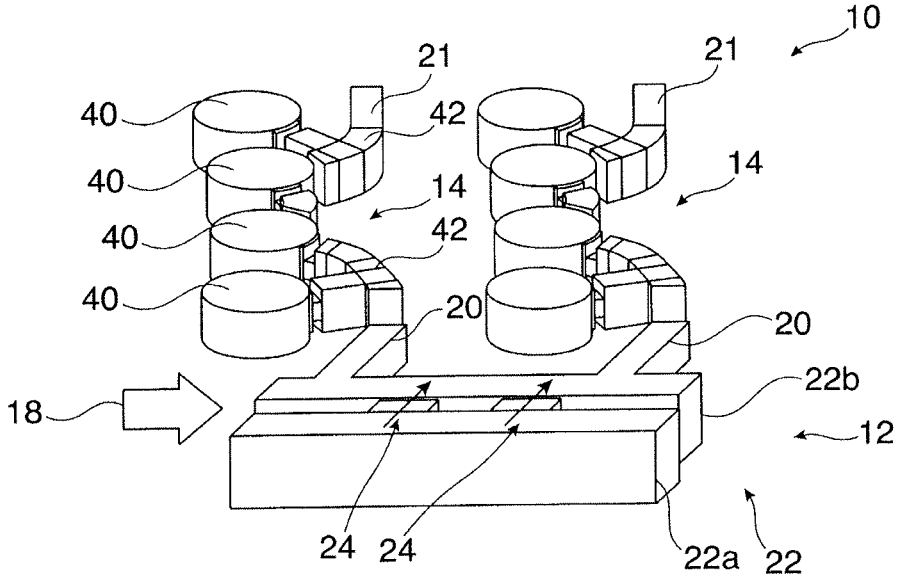
FIG. 2 is a representation of a schematic three-dimensional view of a section of a busbar according to an embodiment of the invention.

FIG. 2 depicts a section of a multiplexer 10 that shows only a section of the busbar 12 with two channel filters 14 that are connected therewith.

As shown in FIG. 2, a channel filter 14 can comprise a plurality of cylinder-shaped resonators 40 that are connected to each other via a channel 42. One or a plurality of resonators can have an adjustable internal volume that can be changed, for example by the actuator 32.

The single waveguides 22*a*, 22*b* (as well as the channel 42) can have a rectangular cross-section. Two coupling members 24 can be disposed between the two filter inputs 20.

Figure 3:
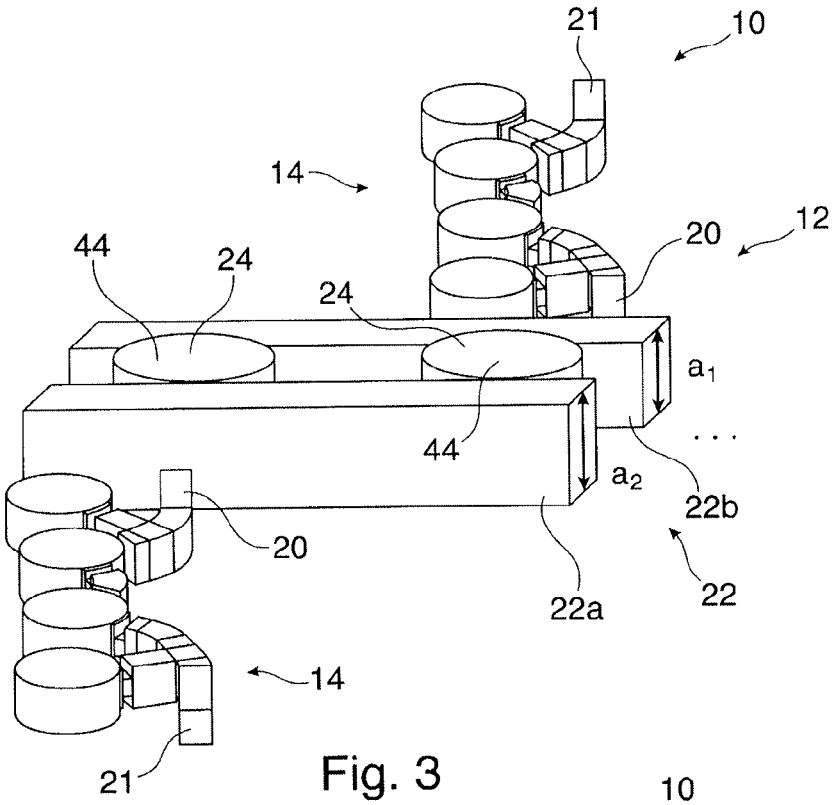
FIG. 3 is a representation of a schematic three-dimensional view of a section of a busbar according to a further embodiment of the invention.

FIG. 3 depicts a further embodiment of a section of a multiplexer 10, analogous to a FIG. 2. As seen in FIG. 3, the single waveguides 22*a*, 22*b* can have different cross-sections, for example a rectangular cross-section with different a-dimensions $a_1$, $a_2$ (and same b-dimensions).

The coupling members 24 can include a coupling resonator 44 that has, for example, an adjustable, cylinder-shaped internal volume or that is circular waveguide, respectively. As depicted in FIG. 3, a coupling member 24 can be disposed (relative to the direction of extension of the dual waveguide 22) between two filter inputs 20 and/or at the height of a filter input 20.

The filter inputs 20 and/or the channel filters 14 can be disposed on both sides of the dual waveguide 22. One channel filter 14 can be connected to the one single waveguide 22*a*, and one channel filter 14 can be connected to the other single waveguide 22*b*.

Figure 4:
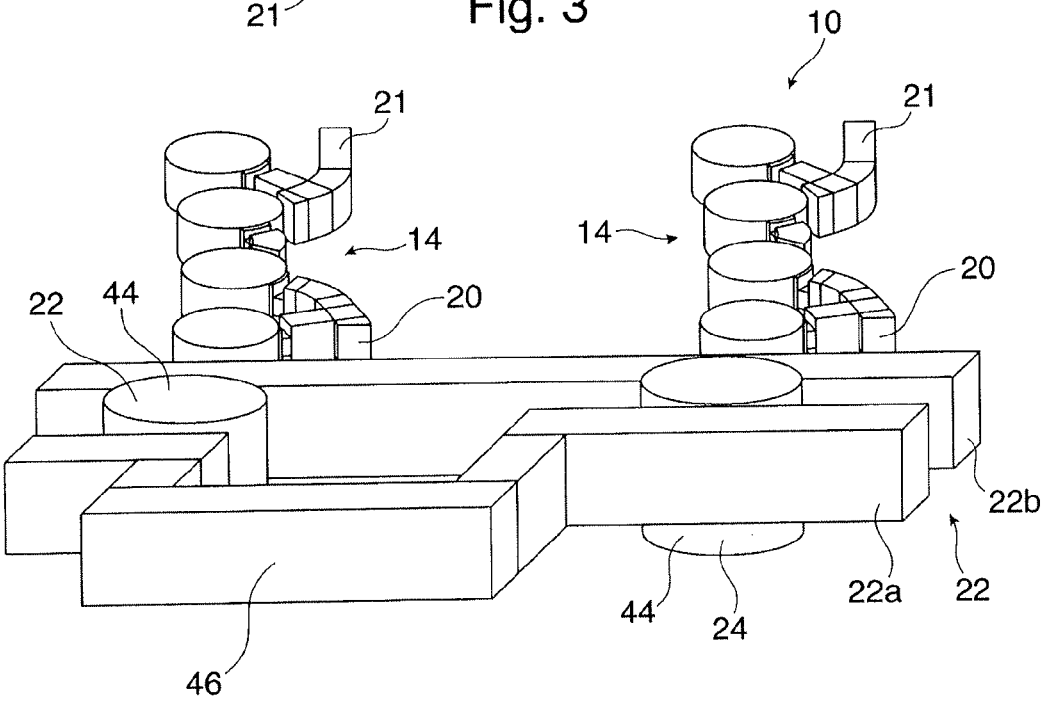
FIG. 4 is a representation of a schematic three-dimensional view of a section of a busbar according to a further embodiment of the invention.

FIG. 4 depicts a further embodiment of a section of a multiplexer 10, analogous to FIGS. 2 and 3. The single waveguide 22*a* therein includes a detour line 46, causing the single waveguide 22*a* to have a greater phase length than the single waveguide 22*b*.

Figure 5:
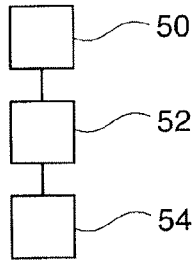
FIG. 5 is a representation of a flow diagram for a method for adjusting a multiplexer according to an embodiment of the invention.

FIG. 5 shows a flow diagram for a method for controlling the multiplexer 10 that can be implemented by the controller 30.

In a step 50, the controller 30 is tasked with readjusting the filters 14 of the multiplexer 10. For example, new mean frequencies and/or bandwidths are preset for the controller 30.

In step 52, the controller 30 computes the corresponding positions of the actuators 32 and adjusts the channel filters 14 accordingly, using the actuators 14.

In step 54, the controller computes a new optimum for the phase lengths of the busbar 12 between the adjusted channel filters 14. Based on these optimal phase lengths, the controller 30 establishes the new position for the actuators 26 and adjusts the coupling members 24 accordingly.

Figure 6:
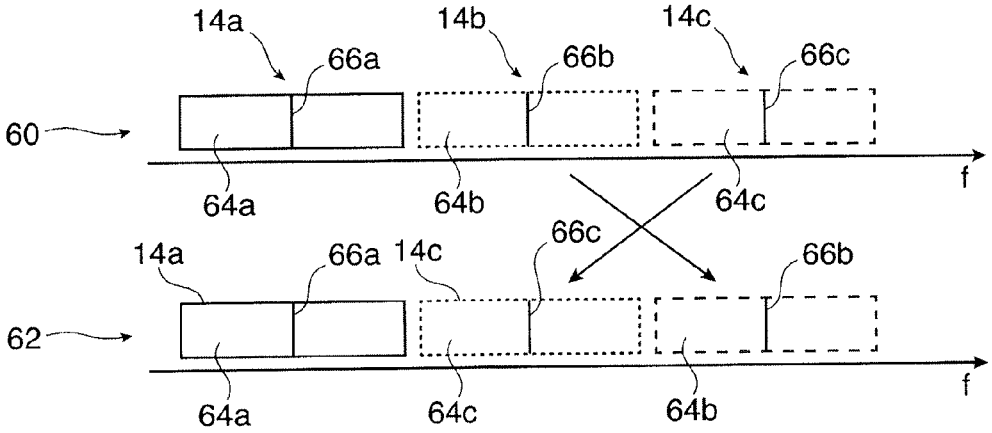
FIG. 6 is a representation of a diagram with frequency plans for a method for adjusting a multiplexer according to an embodiment of the invention.
Figure 7:
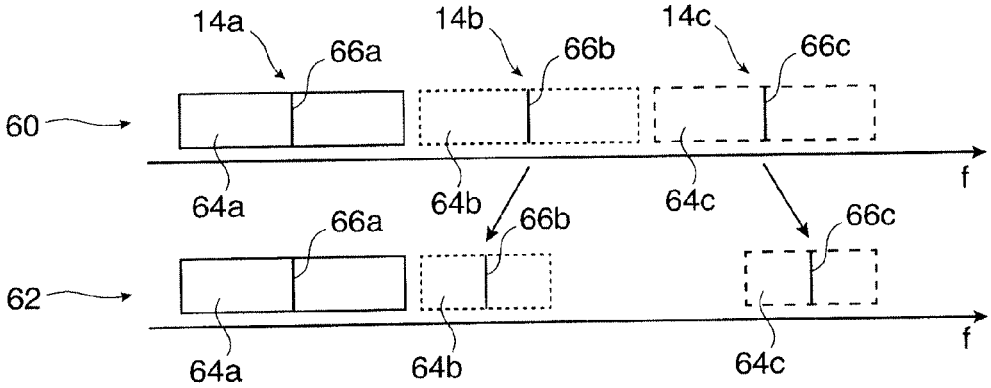
FIG. 7 is a representation of a further diagram with frequency plans for a method for adjusting a multiplexer according to an embodiment of the invention.

Related examples are depicted in FIGS. 6 and 7. Both figures show a respective frequency plan 60 from before and a frequency plan 62 after the adjustment of the channel filters 14*a*, 14*b*, 14*c*. In each of the frequency plans 60, 62, the frequency f is plotted from left to right. Frequency bands and the mean frequencies 66*a*, 66*b*, 66*c* as well as the bandwidths 64*a*, 64*b*, 64*c* for the three filters 14*a*, 14*b*, 14*c* are depicted schematically.

In the example as shown in FIG. 6, the mean frequencies 66*b*, 66*c* of the two channel filters 14*b*, 14*c* are switched, while their bandwidths 64*a*, 64*b*, however, are left the same. The channel filters 14*b*, 14*c* are adjusted correspondingly (wherein the physical arrangement is not switched, however).

FIG. 7 shows a further example where the adjustment of the channel filters 14*b*, 14*c* has a strong influence on the needed phase length of the busbar 12. The bandwidth 64*b*, 64*c* in the two highest filters 14*b*, 14*c* changes therein, whereby both are no longer directly adjacent in the frequency plan 62. (The mean frequencies 66*b*, 66*c* thereof are also shifted therein.) Due to the fact that neighboring filters 14*b*, 14*c* typically have a great influence on one another, correspondingly, the coupling members 24 are also greatly adjusted.

Figure 8:
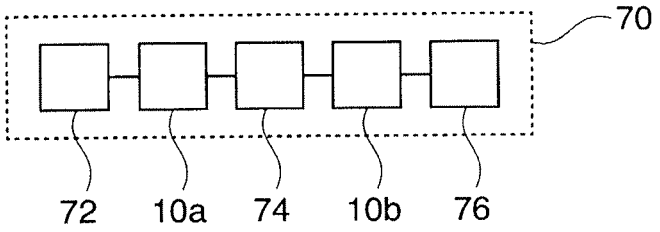
FIG. 8 is a representation of a schematic view of a communications satellite according to an embodiment of the invention.

FIG. 8 shows an application for the multiplexer 10 that relates to the signal processing in a communications satellite 70. A receiving aerial 72 receives a signal that is split into a plurality of single signals by an input multiplexer 10*a*, and which are amplified in an amplifier 74. The output multiplexer (i.e., demultiplexer) recombines the amplified signals into one signal that is emitted by a further aerial 76. The two multiplexers 10*a*, 10*b* can be designed like the multiplexers 10 from FIGS. 1 to 4.

In addition, it must be noted that "comprising" does not exclude any further elements or steps and that "one" or "a(n)" does not exclude a plurality. Further to be noted is the fact that characterizing features or steps that were described with reference to one of the aforementioned embodiments can also be used in combination with other characterizing features or steps than those in the above-described embodiments. Reference symbols in the claims shall not be viewed as limiting the scope of the invention.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A waveguide busbar for conducting microwaves, wherein the waveguide busbar comprises:

a group input configured to couple in a group microwave signal;

a plurality of filter inputs configured to couple in a plurality of microwave signals;

a dual waveguide that comprises a first single waveguide and a second single waveguide, wherein the plurality of the filter inputs are disposed along the dual waveguide; and at least one adjustable coupling member that provides a connection between the first single waveguide and the second single waveguide, and that is configured such that it adjusts a phase length of the connection.

2. The waveguide busbar according to claim 1, wherein the at least one adjustable coupling member is mounted between two adjacently disposed filter inputs of the plurality of filter inputs with respect to a direction of extension of the dual waveguide.

3. The waveguide busbar according to claim 1, wherein the at least one adjustable coupling member includes at least two adjustable coupling members that are disposed between two adjacent filter inputs of the plurality of filter inputs.

4. The waveguide busbar according to claim 1, wherein the first single waveguide and the second single waveguide extend in parallel, and wherein the first single waveguide and the second single waveguide are connected via a plurality of adjustable coupling members that connect the first single waveguide and the second single waveguide in a ladder-like fashion.

5. The waveguide busbar according to claim 1, wherein the first single waveguide or the second single waveguide provide the group input at one end.

6. The waveguide busbar according to claim 1, wherein the first single waveguide has a cross-section that differs from a cross-section of the second single waveguide.

7. The waveguide busbar according to claim 1, wherein the waveguide busbar comprises at least one further adjustable coupling member that connects the first single waveguide with the second single waveguide, and wherein the first single waveguide has a phase length between the at least one adjustable coupling member and the at least one further coupling member that differs from a phase length of the second single waveguide between the at least one adjustable coupling member and the at least one further coupling member.

8. The waveguide busbar according to claim 1, wherein a first filter input of the plurality of filter inputs is mounted on the first single waveguide and a second filter input of the plurality of filter inputs is mounted on the second single waveguide.

9. The waveguide busbar according to claim 1, wherein the at least one coupling member comprises an adjustable aperture.

10. The waveguide busbar according to claim 1, wherein the at least one coupling member comprises an adjustable resonator.

11. The waveguide busbar according to claim 1, further comprising:

an actuator configured to mechanically modify the at least one coupling member.

12. The waveguide busbar according to claim 1, further comprising:

a controller configured to control the at least one coupling member.

13. A multiplexer, comprising:

a waveguide busbar, comprising a group input configured to couple in a group microwave signal;

a plurality of filter inputs configured to couple in a plurality of microwave signals;

a dual waveguide that comprises a first single waveguide and a second single waveguide, wherein the plurality of the filter inputs are disposed along the dual waveguide; and at least one adjustable coupling member that provides a connection between the first single waveguide and the second single waveguide, and that is configured such that it adjusts a phase length of the connection; and a plurality of microwave filters that are connected to the plurality of filter inputs of the waveguide busbar.

14. A method for adjusting a multiplexer that comprises a waveguide busbar, comprising a group input configured to couple in a group microwave signal, a plurality of filter inputs configured to couple in a plurality of microwave signals, a dual waveguide that comprises a first single waveguide and a second single waveguide, wherein the plurality of the filter inputs are disposed along the dual waveguide, and at least one adjustable coupling member that provides a connection between the first single waveguide and the second single waveguide, and that is configured such that it adjusts a phase length of the connection; and a plurality of microwave filters that are connected to the plurality of filter inputs of the waveguide busbar, wherein the method comprises the steps of:

changing a bandwidth or mean frequency of a first microwave filter that is coupled to the dual waveguide; and changing a phase relationship between the first microwave filter and a second microwave filter, which is coupled to the dual waveguide, by adjusting a coupling member that connects the first single waveguide and the second single waveguide.

* * * * *